United States Patent [19]

Chao et al.

[11] 4,264,461

[45] Apr. 28, 1981

[54] STABILIZATION OF HYDROCRACKED OILS WITH ALIPHATIC AMINE COMPONENTS

[75] Inventors: Tai S. Chao, Homewood; Aubrey C. Smith, Jr., Harvey, both of Ill.

[73] Assignee: Atlantic Richfield Company, Philadelphia, Pa.

[21] Appl. No.: 78,997

[22] Filed: Sep. 26, 1979

Related U.S. Application Data

[63] Continuation-in-part of Ser. No. 963,636, Nov. 24, 1978, abandoned.

[51] Int. Cl.[3] ..... C10M 1/32

[52] U.S. Cl. ..... 252/50; 252/401; 585/2

[58] Field of Search ..... 252/50, 401; 208/18

[56] References Cited

U.S. PATENT DOCUMENTS

| | | | |
|---|---|---|---|
| 2,758,086 | 8/1956 | Stuart et al. | 252/50 X |
| 2,832,741 | 4/1958 | Gottshall et al. | 252/50 |
| 3,240,696 | 3/1966 | Halik et al. | 208/18 X |
| 3,403,092 | 9/1968 | Rausch | 208/18 X |
| 3,642,610 | 2/1972 | Divijak, Jr. et al. | 208/18 X |
| 3,702,299 | 11/1972 | Hartle et al. | 252/50 |
| 3,915,871 | 10/1975 | Bryer et al. | 252/50 X |
| 4,031,016 | 6/1977 | Berger et al. | 252/50 |
| 4,036,770 | 7/1977 | Espenscheid et al. | 252/51.5 R |

*Primary Examiner*—Andrew Metz

*Attorney, Agent, or Firm*—Frank J. Uxa

[57] ABSTRACT

Hydrocracked lubricating oils are effectively stabilized against deterioration caused by light by the inclusion of at least one of certain substantially aliphatic amine components. Such substantially aliphatic amine components provide outstanding inhibition relative to aromatic amine components.

13 Claims, No Drawings

STABILIZATION OF HYDROCRACKED OILS WITH ALIPHATIC AMINE COMPONENTS

This application is a continuation-in-part of application Ser. No. 963,636, filed Nov. 24, 1978 and now abandoned.

The invention relates to a method of stabilizing a hydrocracked oil. More particularly, it relates to stabilizing such oils against light and/or air deterioration by adding thereto at least one of certain substantially aliphatic amine components.

It is known that oils in general will degrade slowly in the presence of light and/or air. Oils such as the economically valuable hydrocracked lubricating oils used in this invention, degrade in light, especially in the presence or absence of air. Since the hydrocracked oils are valuable, there has been considerable effort to find ways to prevent their breakdown due to light and air.

U.S. Pat. No. 4,036,770 teaches a method for stabilizing hydrocracked oils which involves adding nitro-containing aromatic amine components. Such components are relatively expensive and therefore may add significantly to the cost of the hydrocracked oils.

One object of the present invention is to provide an improved method for stabilizing hydrocracked oils against the deteriorating effects of light.

Another object of the invention is to provide an improved composition of matter involving a hydrocracked oil which have improved inhibition against deterioration by light. Other objects and advantages of the present method will become apparent hereinafter.

An improved hydrocracked oil composition has now been discovered. This composition, which is free of added aromatic amine component, comprises a major amount, preferably at least about 70%, by weight of a hydrocracked lubricating oil and a minor amount by weight of at least one added aliphatic amine component having a structure:

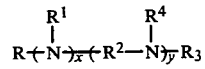

wherein R, $R^1$, $R^3$ and $R^4$ are each independently selected from the group consisting of H and substantially aliphatic monovalent hydrocarbonaceous radicals containing about 2 to about 24, preferably about 2 to about 14 and more preferably about 2 to about 10, carbon atoms, provided that at least one of R, $R^1$, $R^3$ and $R^4$ is a substantially aliphatic monovalent hydrocarbonaceous radical; x and y are integers independently selected from integers in the range of 0 to about 10, provided that at least one of x and y equal at least one; and $R^2$ is a substantially aliphatic divalent hydrocarbonaceous radical containing about 1 to about 10 carbon atoms.

In a preferred embodiment, x equals one and y equals zero. Also, it is prefered that the hydrocarbonacous radicals be substantially saturated.

An improved method of stabilizing hydrocracked lubricating oils against deterioration by light involves adding such amine components to the oil.

In a preferred embodiment, the added aliphatic amine component comprises about 0.01% to about 2.0%, more preferably, about 0.03% to about 0.5%, by weight of the total composition.

The term "hydrocracked lubricating oil" means an oil, preferably a mineral oil, of lubricating viscosity which is derived from a lubricating oil produced by contacting a hydrocarbon feedstock with hydrogen, preferably in the presence of catalyst effective to promote hydrocracking, at hydrocarbon hydrocracking conditions to produce an oil of lubricating viscosity having an increased viscosity index relative to the viscosity index of the hydrocarbon feedstock. In addition, the hydrocracking lubricating oil may be subjected to additional processing, e.g., further contacting with hydrogen-again preferably in the presence of an effective catalyst-, other purifying procedures and the like, to further improve the quality, e.g., color, of the hydrocracked lubricating oil. For example, hydrocracked lubricating oils useful in the present invention may be obtained by the processes disclosed in U.S. Pat. No. 3,642,610, the specification of which is hereby incorporated by reference herein.

Typical examples of the substantially aliphatic monovalent hydrocarbonaceous radicals from which R, $R^1$, $R^3$ and $R^4$ may be selected includes alkyl such as ethyl, propyl, butyl, pentyl, hexyl (including cyclohexyl), octyl, decyl, dodecyl, hexadecyl, stearyl and the like; and alkenyl such as ethylenyl, propenyl, butenyl, oleyl, linoleyl and the like. As noted above, it is preferred that such hydrocarbonaceous radicals be substantially saturated.

Typical examples of substantially aliphatic divalent hydrocarbonaceous radicals represented by $R^2$ which are suitable include alkylene such as ethylene, propylene, butylene and the like radicals; alkylidene such as ethylidene, propylidene, butylidene and the like radicals; alkenylene such as propenylene, butenylene and pentenylene and the like radicals; alkenylidene such as propenylidene, butenylidene, pentenylidene and the like radicals. $R^2$ is preferably substantially saturated.

By "essentially hydrocarbon" (i.e., hydrocarbonaceous) radical is meant those radicals which are composed mainly of hydrogen and carbon, and include such radicals which contain, in addition, minor amounts of substituents, such as chlorine, bromine, oxygen, sulfur, nitrogen and the like, which do not substantially affect their hydrocarbon character.

The following examples illustrate more clearly the compositions and methods of the present invention. However, these illustrations are not to be interpreted as specific limitations on this invention.

EXAMPLES

These examples illustrate certain of the benefits of the present invention.

A hydrocracked oil of lubricating viscosity was selected for testing. This hydrocracked oil had an initial boiling point of 545° F., a viscosity of 474 SUS at 100° F. and a viscosity index of 102. This material was derived from processing according to U.S. Pat. No. 3,642,610.

Various amine-type additives were incorporated into samples of this hydrocracked oil. Compositions which included added aliphatic amine components did not contain added aromatic amine components. The additive containing samples were placed near a window and exposed to indirect sunlight for a period of time. Formation of precipitate material in the samples, if and when it occurred was noted. In addition, the samples were subjected to color tests (ASTM D-1500) at regular intervals.

Results of these observations and tests were as follows:

TABLE 1

Effectiveness of Aliphatic Amines as Precipitate Inhibitors

| Sample Number | Additive | % wt. | Weeks Without Precipitate in Window Exposure Test |
|---|---|---|---|
| 1 | None (100% Hydrocracked Oil | — | 1 |
| 2 | p,p'-dioctyl-diphenylamine | 0.10 | 2 |
| 3 | n-Butylamine | 0.10 | 12 |
| 4 | Cyclohexylamine | 0.10 | 9 |
| 5 | 2-Ethylhexylamine | 0.05 | 5 |
| 6 | t-Octylamine | 0.05 | 9 |
| 7 | Di-n-propylamine | 0.10 | 11 |
| 8 | Di-n-propylamine | 0.05 | 8 |
| 9 | Di-n-butylamine | 0.05 | 16 |
| 10 | Di-amylamine | 0.10 | 13 |
| 11 | Di-amylamine | 0.05 | 7 |
| 12 | Fatty diamine(1) | 0.05 | 8 |
| 13 | Triethylamine | 0.05 | 10 |
| 14 | Fatty secondary amine(2) | 0.20 | 6 |

(1)having a structure:

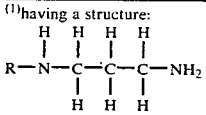

wherein R is the alkyl group of coconut oil fatty acids.
(2)a secondary amine derived from coconut fatty acids.

TABLE 2

Effectiveness of Aliphatic Amine as Color Inhibitors

| Sample Number | Color (ASTM D-1500) Weeks of Window Exposure | | | | |
|---|---|---|---|---|---|
| Weeks | 0 | 2 | 6 | 11 | 14 |
| 1 | 1–2 | 6–7 | 7–8 | 8 | 8 |
| 2 | 1–2 | 7–8 | 7–8 | 8 | 8 |
| 3 | 1–2 | 2 | 5–6 | 6–7 | 7 |
| 4 | 1–2 | 2 | 2–3 | 6–7 | 7 |
| 5 | 1–2 | 1–2 | 7–8 | 8 | 8 |
| 6 | 1–2 | 1–2 | 7–8 | 7–8 | 7–8 |
| 7 | 1–2 | 4–5 | 5–6 | 6–7 | 6–7 |
| 8 | 1–2 | 4–5 | 6 | 6–7 | 6–7 |
| 9 | 1–2 | 1–2 | 2–3 | 5–6 | 6–7 |
| 10 | 1–2 | 1–2 | 1–2 | 6–7 | 6–7 |
| 11 | 1–2 | 4–5 | 6–7 | 7–8 | 7–8 |
| 12 | 1–2 | 1–2 | 5–6 | 5–6 | 5–6 |
| 13 | 1–2 | 4–5 | 5–6 | 6–7 | 6–7 |
| 14 | 1 | 2 | 3 | — | — |

These results indicate that hydrocracked lubricating oil alone are susceptible to deterioration by sunlight. In addition, aromatic amine such as p,p'-dioctyldiphenylamine which is a well known antioxidant are shown to be quite ineffective in reducing this susceptibility.

In contrast, the aliphatic amines, as set forth in the present invention, are shown to provide substantial inhibition of deterioration of hydrocracked oil by sunlight. Clearly, such results are surprising, particularly in view of the relative ineffectiveness of the aromatic amine.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A composition of matter comprising a major amount by weight of a hydrocracked lubricating oil and a minor amount by weight of at least one added aliphatic amine component having a structure

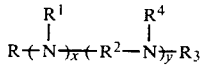

wherein R, $R^1$,$R^3$ and $R^4$ are each independently selected from the group consisting of H and substantially aliphatic monovalent hydrocarbonaceous radicals containing about 2 to about 24 carbon atoms, provided that at least one of R, $R^1$,$R^3$ and $R^4$ is a substantially aliphatic monovalent hydrocarbonaceous radical; x and y are integers independently selected from integers in the range of 0 to about 10, provided that at least one of x and y equals at least one; and $R^2$ is a substantially aliphatic divalent hydrocarbonaceous radical containing about 1 to about 10 carbon atoms, said amine component being present in an amount effective to reduce the susceptibility of sunlight decoloration of said hydrocracked oil and said composition being free of added aromatic amine component.

2. The composition of claim 1 wherein said hydrocracked lubricating oil comprises at least about 70% by weight of said composition.

3. The composition of claim 2 wherein x equals one and y equals zero.

4. The composition of claim 2 wherein said added amine component comprises about 0.01% to about 2.0% by weight of said composition.

5. The composition of claim 2 wherein said added amine component comprises about 0.03% to about 0.5% by weight of said composition.

6. The composition of claim 3 wherein said added amine component comprises about 0.03% to about 0.5% by weight of said composition.

7. The composition of claim 3 wherein said added amine component comprises about 0.3% to about 0.5% by weight of said composition.

8. A method of inhibiting a hydrocracked lubricating oil free of added aromatic amine component from decoloration caused by sunlight comprising combining with said oil an inhibiting amount of at least one aliphatic amine component having a structure:

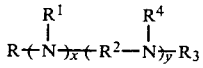

wherein R, $R^1$,$R^3$ and $R^4$ are each independently selected from the group consisting of H and substantially aliphatic monovalent hydrocarbonaceous radicals containing about 2 to about 24 carbon atoms, provided that at least one of R, $R^1$,$R^3$ and $R^4$ is a substantially aliphatic monovalent hydrocarbonaceous radical; x and y are integers independently selected from integers in the range of 0 to about 10, provided that at least one of x and y equals at least one; and $R^2$ is a substantially aliphatic divalent hydrocarbonaceous radical containing about 1 to about 10 carbon atoms.

9. The method of claim 8 wherein x equals one and y equals zero.

10. The method of claim 8 wherein said amine is present in an amount equal to about 0.01% to about 2.0% by weight of the total hydrocracked lubricating oil-amine component combination.

11. The method of claim 8 wherein said amine is present in an amount equal to about 0.03% to about 0.5% by weight of the total hydrocracked lubricating oil-amine component combination.

12. The method of claim 9 wherein said amine is present in an amount equal to about 0.01% to about 2.0% by weight of the total hydrocracked lubricating oil-amine component combination.

13. The method of claim 9 wherein said amine is present in an amount equal to about 0.03% to about 0.5% by weight of the total hydrocracked lubricating oil-amine component combination.

* * * * *